United States Patent [19]

Nutz

[11] 4,093,907

[45] June 6, 1978

[54] REFERENCE SOURCE FOR PRODUCING A CURRENT WHICH IS INDEPENDENT OF TEMPERATURE

[75] Inventor: Karl-Diether Nutz, Heilbronn, Germany

[73] Assignee: Licentia Patent-Verwaltungs-G.m.b.H., Frankfurt am Main, Germany

[21] Appl. No.: 743,143

[22] Filed: Nov. 18, 1976

[30] Foreign Application Priority Data

Nov. 28, 1975 Germany ..... 2553431

[51] Int. Cl.[2] ..... G05F 1/58

[52] U.S. Cl. ..... 323/1; 307/297; 323/19; 323/22 Z

[58] Field of Search ..... 323/1, 4, 9, 19, 22 T, 323/22 Z, 68, 69; 307/296, 297, 302

[56] References Cited

U.S. PATENT DOCUMENTS

| | | | |
|---|---|---|---|
| 3,428,897 | 2/1969 | Rew et al. | 323/22 Z |
| 3,648,153 | 3/1972 | Graf | 323/1 |
| 3,908,162 | 9/1975 | Marley et al. | 323/19 |
| 3,916,508 | 11/1975 | Conzelmann et al. | 323/22 Z |
| 3,956,661 | 5/1976 | Sakamoto et al. | 323/4 |
| 4,008,418 | 2/1977 | Murphy | 323/22 Z |
| 4,030,023 | 6/1977 | Keith | 323/22 Z |

OTHER PUBLICATIONS

"A New Dimension to Monolithic Voltage regulators" by Chu and Oswald; *IEEE Trans. Broadcast & Tele. Receivers* vol. B7R-18, No. 2 May 1972 pp. 73-76.

"On-Chip Heater Helps to Stabilize Monolithic Zener" by Dobkin *Electronics* Sep. 16, 1976, pp. 106-112.

*Primary Examiner*—Gerald Goldberg

*Attorney, Agent, or Firm*—Spencer & Kaye

[57] ABSTRACT

A reference source for producing a current independent of temperature comprises a constant current source which feeds two parallel connected current branches each including a Zener diode of a different Zener voltage, one or more diodes driven in the forward direction in the branches, a transistor forming part of a current mirror circuit and having an output voltage across its collector-emitter path substantially determined by the difference in the Zener voltages, and a transistor circuit to which the output voltage of the above transistor is fed. The transistors of the transistor circuit and the diodes are selected so as to render the output current of the reference source independent of temperature with the assistance of the current mirror circuit.

7 Claims, 1 Drawing Figure

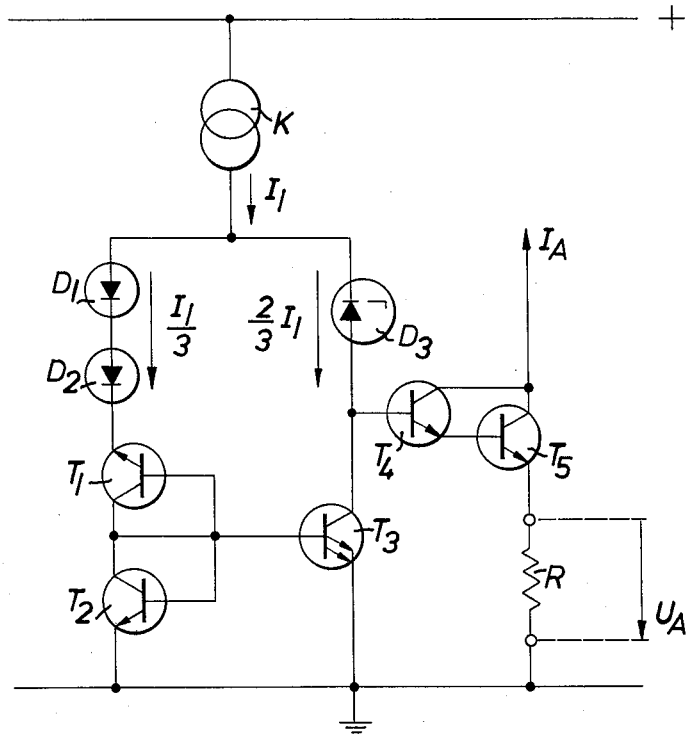
+
K
$I_1$
$I_A$
$D_1$
$D_2$
$\frac{I_1}{3}$
$\frac{2}{3}I_1$
$D_3$
$T_1$
$T_2$
$T_3$
$T_4$
$T_5$
R
$U_A$

REFERENCE SOURCE FOR PRODUCING A CURRENT WHICH IS INDEPENDENT OF TEMPERATURE

BACKGROUND OF THE INVENTION

The invention relates to a reference source for producing a current which is independent of temperature. More particularly the present invention relates to such a reference source which is made up of two parallel-connected current branches containing diodes and supplied by a constant current source, with one of these current branches containing a transistor, at the collector-emitter path of which the output voltage decreases for a transistor circuit which is connected at the output side of the reference source, and the current, which is independent of temperature, flows through the transistor circuit.

Temperature compensating d.c. voltage reference sources are already known comprising two parallel-connected current branches which contain diodes and transistors. In the known circuit a temperature compensating differential voltage is produced at the ends of a diode chain, with this differential voltage decreasing along the collector-emitter path of a transistor.

SUMMARY OF THE INVENTION

The object of the present invention is to produce a current which is variable and independent of temperature over a wide range. The circuit necessary for this should comprise a few components, which may be accommodated in a common semiconductor body as an integrated circuit.

According to a first aspect of the invention, there is provided a reference source for producing a current independent of temperature comprising a constant current source, two parallel connected current branches supplied by said current source, each said branch including a Zener diode of a different Zener voltage, a current mirror circuit in said current branches, a first transistor forming part of said current mirror circuit and producing an output voltage across its collector-emitter path substantially determined by the difference in the Zener voltages of said two Zener diodes, a plurality of diodes driven in the forward direction in said current branches and a transistor Darlington circuit to which the output voltage of said first transistor is fed with the transistors of Darlington circuit being selected, together with said plurality of diodes, for rendering the output current of the reference source independent of temperature with the assistance of said current mirror circuit.

According to a second aspect of the invention, there is provided a reference source for producing a current which is independent of temperature comprising two parallel-connected current branches supplied by a constant current source and containing diodes; one branch including a transistor, across the collector-emitter path of which the output voltage is taken for a transistor circuit connected on the output side, through which the current, which is independent of temperature, flows, characterized in that each current branch contains a Zener diode; that the output voltage across the collector-emitter path of a first transistor is determined substantially by the difference in the Zener voltages of the two Zener diodes, which are different from one another; that the first transistor is part of a current mirror arranged in the two current branches; that the remaining diodes driven in the forward direction in the two current branched and the further transistors of the transistor circuit connected at the output side are selected so that the output current is independent of temperature when there is a distribution of the currents over the two current branches, this being forced by the current mirror circuit.

BRIEF DESCRIPTION OF THE DRAWING

The invention will now be described in greater detail, by way of example with reference to the drawing, the single FIGURE of which is a circuit diagram of one embodiment of the invention.

DESCRIPTION OF THE PREFERRED EMBODIMENT

In a preferred embodiment of the invention, with a reference source of the type described at the outset, it is proposed that each current branch contains a Zener diode; that the output voltage at the collector-emitter path of the transistor $T_3$ is determined substantially by the difference in the Zener voltages of the two different Zener diodes; that the transistor $T_3$ is a part of a current mirror circuit arranged in both current branches; that the remaining diodes in the two current branches, which are driven in the flow direction, and the transistors of the transistor circuit connected at the output side are so selected that upon dividing up the currents, on both current branches, which division is forced by the current mirror circuit, the output current is independent of temperature.

The knowledge underlying the invention is that as a result of the difference in the Zener voltages of two different Zener diodes a relatively large voltage value may be produced at the input of the transistor circuit connected at the output side. This makes it possible to vary the temperature compensated current in the transistor circuit connected thereafter over a wide range by changing the load resistor in the emitter supply line of the transistor of the final stage. The voltage drop across this load resistor is then equally independent of temperature.

The invention takes into account moreover the knowledge that the temperature coefficients of the semiconductor construction elements are dependent on current. The circuit for compensating the temperature coefficients thus contains a current mirror circuit or repeater, by means of which the currents are divided up over the two current branches of the circuit so that summed temperature coefficient of the entire circuit which becomes effective is as equal as possible to zero.

The circuit underlying the invention thus contains, apart from the constant current source, diodes driven in the forward direction, Zener diodes and transistors as well as a load resistor. Only the load resistor is connected up externally, while all remaining constructional elements, including the constant current source, are integrated in a common semiconductor body. Thus one Zener diode is provided by the emitter-base-pn junction of a transistor, this emitter-base-pn junction being stressed in the blocking direction when the base-collector junction is short-circuited. The other Zener diode is formed by a pn-junction which is let into an area of the same conductivity type and having the same imperfection or impurity concentration as the separation diffusion zones used for the integrated circuit. The difference between the two Zener voltages of the Zener diodes manufactured in this manner amounts to approximately 1.2 volts. The diodes driven in the forward direction also comprise emitter-base-pn junctions of transistors manufactured by integrated circuit technology.

In a preferred form, one current branch contains the Zener diode comprising the emitter-base path of a transistor, two diodes $D_1$ and $D_2$ connected one behind the other and connected to the constant current source and a diode connected to the earth terminal and formed from the base-emitter path of a transistor, this latter diode being a part of the current mirror circuit. Parallel to this base-emitter path, one or several base-emitter paths of a transistor connected in parallel one after the other are connected in the other current branch. The current distribution to the two current branches is determined by the number of base-emitter paths connected in parallel. The transistor belonging to the current mirror circuit is connected to the second Zener diode which is connected, in turn, to the constant current source. In a preferred embodiment, the current distribution to the two current branches is undertaken such that twice as large a current flows through one Zener diode as flows through the other Zener diode.

In the embodiment shown in the drawing, the circuit comprises transistors and Zener diodes in an integrated circuit, in which the base areas have a film or sheet resistance of 200 DHMS per square. The separation diffusion areas have a film resistance of 8 - 10 DHMS per square at a penetration depth of approximately 11 μm. The circuit shown is so designed that a current constancy of ±0.5% is achieved over a temperature range of 20° C to 100° C. The internal constant current source K supplies a current $I_1$, a third of which flows across the one current branch and two-thirds of which flow across the other branch. This distribution of current has proved to be advantageous when taking into consideration the dependence of the temperature coefficients on the current.

The left-hand current branch as shown in the FIGURE comprises four components connected in series i.e. two diodes $D_1$, $D_2$ stressed in the forward direction, a Zener diode $T_1$ and the diode $T_2$. The Zener diode $T_1$ comprises the emitter-base-pn junction, stressed in the blocking direction of a transistor with a short-circuited collector base path, while diode $T_2$ — as are diodes $D_1$, $D_2$ — is formed by a base-emitter-pn junction, stressed in the forward direction, of a transistor also with a short-circuited collector-base path. The emitter of the diode $T_2$ is connected to earth or ground.

This diode $T_2$ forms a current mirror circuit together with the transistor $T_3$ in the other current branch. In order to force the current distribution already mentioned, two base-emitter paths of the transistor $T_3$ are connected in parallel to the diode $T_2$. As the transistors $T_2$ and $T_3$ are completely identical in construction, a third of the current must flow away across each emitter. The emitters of the transistor $T_3$ are also connected to earth while in the collector path a Zener diode $D_3$ is inserted, with this diode$D_3$ having been inserted into an area of the same conductivity type and having the same impurity concentration as the separation diffusion areas for the integrated circuit. The cathode of this Zener diode $D_3$ is connected to the constant current source K. A Darlington transistor circuit including transistors $T_4$ and $T_5$ is attached to the collector of the transistor $T_3$ by the base electrode of the input transistor $T_4$. The temperature compensated current $I_A$ flows across the collector-emitter paths of the transistors $T_4$, $T_5$, with this current $I_A$ producing the equally compensated voltage $U_A$ at the emitter resistor R of $T_5$. The magnitude of the current $I_A$ is given from the magnitude of the externally attached resistor R.

In an advantageous mode of operation of the circuit shown, the constant current source K emits a current of 100 μuA. Of this approximately 33 μuA flows across the left-hand current branch of the stabilizing circuit, while approximately 66 μuA flows across the right-hand current branch having the diode $D_3$. A voltage of approximately 2 volts then drops across the collector-emitter path of the transistor $T_3$. The diodes $D_1$ and $D_2$ together have a temperature coefficient of approximately −4.5 mV/° C. The temperature coefficient of the Zener diode $T_1$ amounts to +3.745 mV/° C. The diode $T_2$ has a temperature coefficient of −2.25 mV/°C. Thus the left-hand current branch has a total temperature co-efficient of approximately −3.005 mV/° C. Of this the temperature coefficient of the Zener diode $D_3$ may be removed at a value of +2.07 mV/° C so that a total value of −5.075 mV/° C is produced. The temperature coefficient of the two transistors $T_4$ and $T_5$ together amounts to −5.05 mV/° C so that, from this, a temperature coefficient of the voltage $U_A$ of approximately 0.025 mV/° C is the result.

The described circuit, by making as a basis a current $I_1 = 100$ μuA, which at a constant current source K of common type oscillates about ±0,75 %/° C and with a desired output current of $I_A = 10$ μuA it is possible to assume that the voltage $U_A = I_A$. R has a temperature coefficient of $35 \times 10^{-6}$ volts/° C at the most. Tests have shown that the deviation in voltage in the temperature range between 20° and 100° C does not exceed ±0.5 %.

It will be understood that the above description of the present invention is susceptible to various modification changes and adaptions.

What is claimed is:

1. A reference source for producing an output current independent of temperature comprising:

a constant current source;

first and second Zener diodes of different Zener voltage;

two parallel-connected current branches supplied by said current source with each said branch including one of said Zener diodes and at least one of said branches including a plurality of series connected diodes driven in the forward direction;

a current mirror circuit having components in each of said current branches and including a first transistor, whose emitter-collector path is connected in one of said current branches, for producing an output voltage across its collector-emitter path substantiallly determined by the difference in the Zener voltages of said first and second Zener diodes; and a transistor Darlington circuit to which the output voltage of said first transistor is fed, said Darlington circuit including second and third transistors, with said second transistor having its base connected to the collector of said first transistor, and a resistor, which determines the magnitude of the output current of said reference source, connected in the emitter path of said third transistor; and wherein said transistors of said Darlington circuit and said diodes driven in the forward direction are selected so as to render said output current of said reference source independent of temperature when there is a distribution of currents over said two current branches as forced by said current mirror circuit.

2. A reference source as defined in claim 1, and comprising a common semiconductor body in which all construction elements are integrated.

3. A reference source as defined in claim 2, wherein one of said Zener diodes is formed by the base-emitter path of a further transistor while the other of said Zener diode is formed in a zone which is of the same conductive type and has the same impurity concentration as the area provided in the integrated circuit for the separation diffusion area.

4. A reference source as defined in claim 1 wherein: the other of said two current branches includes two of said diodes driven in the forward direction connected between said constant current source and said first Zener diode, and a further diode driven in the forward direction connected between said first Zener diode and earth; said first Zener diode is formed by a base to emitter path of a fourth transistor, and said diode connected to earth is formed by the base to emitter path of a fifth transistor; said first transistor has at least one base-emitter path connected in parallel with said base-emitter path of said fifth transistor in order to form said current mirror circuit; and said collector of said first transistor is connected via said second Zener diode to said constant current source.

5. A reference source as defined in claim 4 wherein said first transistor has two parallel-connected base-emitter paths so that a current flows through said second Zener diode which is twice as large as the current which flows through said first Zener diode.

6. A reference source for producing an output current which is independent of temperature comprising: a constant current source; two parallel-connected current branches connected to and supplied by said constant current source with each of said current branches including a Zener diode of a different Zener voltage and at least one of said branches including a plurality of semiconductor diodes driven in the forward direction and connected in series with the associated one of said Zener diodes; a current mirror circuit having components in each of said current branches, said components including a further semiconductor diode driven in the forward direction connected in series in one of said current branches for coupling same to a point of reference potential and a first transistor having its base-emitter path connected in parallel with said further semiconductor diode and its collector emitter path connected in the other of said current branches and coupling same to said point of reference potential so that the voltage across the collector emitter path of said first transistor is substantially determined by the difference in Zener voltages of said two Zener diodes; a Darlington circuit, including second and third transistors, attached to the collector of said first transistor via the base of said second transistor; a load resistor connected in the emitter path of said third resistor; and wherein the temperature coefficients of the components in said two current branches, including said semiconductor diodes, said Zener diodes and said components of said current mirror circuit, are selected to compensate the temperature coefficient of said Darlington circuit, whereby the output current through said load resistor is independent of temperature when there is a distribution of currents through said two current branches caused by said current mirror circuit and the magnitude of the said output current is determined by the value of said load resistor.

7. A reference source as defined in claim 6 wherein said first transistor has a plurality of base-emitter paths each connected in parallel with said further semiconductor diode.

* * * * *